United States Patent [19]

Kubo et al.

[11] 4,127,626

[45] Nov. 28, 1978

[54] METHOD AND APPARATUS FOR AUTOMATICALLY REPAIRING THE LINING OF A FURNACE

[75] Inventors: Sueki Kubo, Kitakyushu; Katsuya Toso, Ashiya; Masayuki Fujita, Kitakyushu, all of Japan

[73] Assignee: Kurosaki Refractories Co., Ltd., Fukuoka, Japan

[21] Appl. No.: 774,310

[22] Filed: Mar. 4, 1977

Related U.S. Application Data

[62] Division of Ser. No. 691,111, May 28, 1976, Pat. No. 4,085,894.

[30] Foreign Application Priority Data

Jun. 24, 1975 [JP] Japan ..... 50/79104

[51] Int. Cl.[2] ..... F27D 1/16

[52] U.S. Cl. ..... 264/30; 266/281

[58] Field of Search ..... 264/30; 266/281

[56] References Cited

U.S. PATENT DOCUMENTS 3,351,460 11/1967 Demaison ..... 264/30 X

FOREIGN PATENT DOCUMENTS 1,528,137 6/1968 France ..... 266/281

467,111 7/1975 U.S.S.R. ..... 266/281

*Primary Examiner*—Thomas P. Pavelko

*Attorney, Agent, or Firm*—Frank J. Jordan

[57] ABSTRACT

The lining of a furnace is automatically repaired by use of a movable transport car on which a vertically disposed spray pipe is capable of being vertically displaced along its longitudinal axis and of being rotated about its longitudinal axis. The transport car is moved to a position underlying a furnace, and the spray pipe is elevated into the furnace to thereby dispose a spray nozzle on the end of the spray pipe within the furnace. The spray nozzle is directed to spray refractory material onto the abraded, eroded, and spalled areas of the refractory lining within the furnace.

8 Claims, 15 Drawing Figures

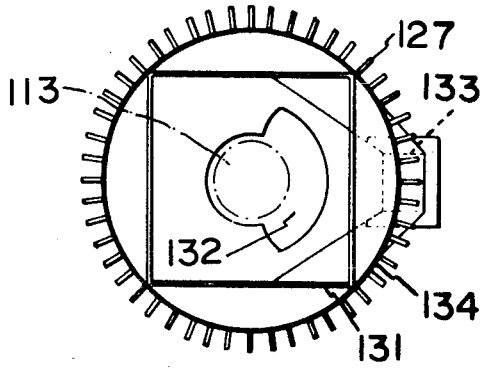
FIG. 11
FIG. 10
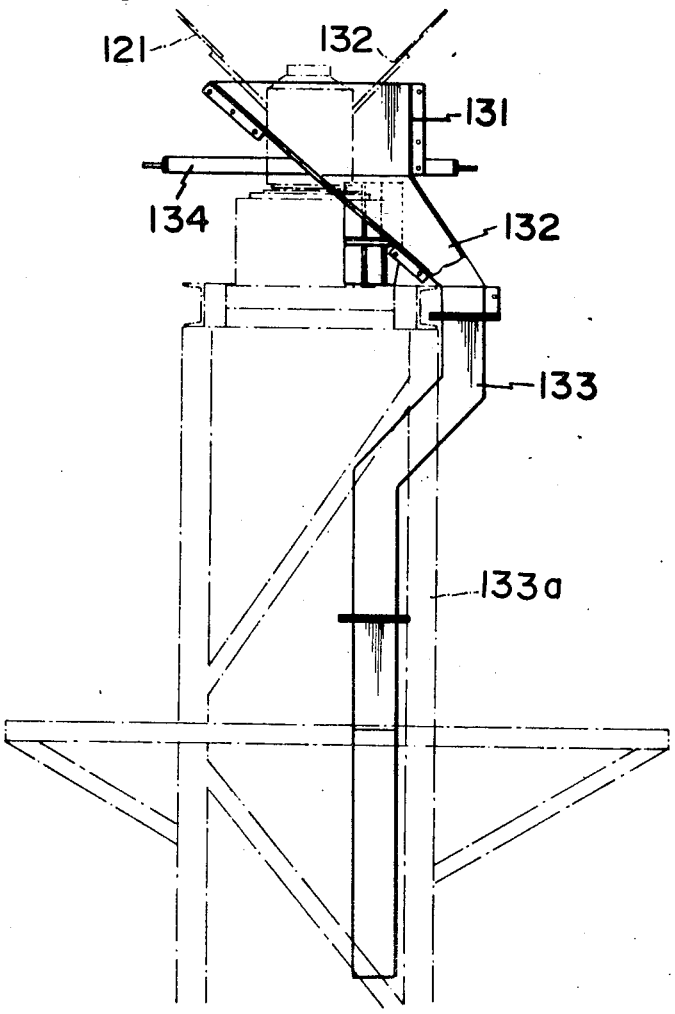

METHOD AND APPARATUS FOR AUTOMATICALLY REPAIRING THE LINING OF A FURNACE

This is a division of application Ser. No. 691,111, filed May 28, 1976, now U.S. Pat. No. 4,085,894.

BACKGROUND OF THE INVENTION

This invention is directed to a method and apparatus for efficiently conducting the repair operation of the lining of a furnace constructed by the DH degassing method or the RH degassing method.

Great improvements in the field of degassing methods of refining molten metal or steel have been observed in the past few decades.

Among all the degassing methods, the method and apparatus for repairing furnace linings according to the present invention is applicable to the furnaces constructed by the DH degassing method or the RH degassing method. The above two degassing methods are briefly explained hereinafter.

The DH degassing method was developed by Dortmund Hörder Hüttenunion A.G. of West Germany around 1956. This method utilizes a vacuum vessel hereinafter referred to as a DH furnace which is characterized by having a suction tube vertically and integrally attached to the bottom of the DH furnace. In the degassing operation, the ladle in which the molten steel is charged is carried to a position immediately below the DH furnace. After immersing the distal end of the suction pipe into the molten steel, the vacuum within the DH furnace is increased so that the molten steel is sucked up into the DH furnace and is degassed. Then by either lowering the ladle or raising the DH furnace, the degassed molten steel returns to the ladle and is mixed with the molten steel within the ladle. The degassing operation is completed by repeating the above sucking and discharging operation 30 to 35 times.

The RH degassing method was developed by Heraeus Co., Ltd. of West Germany and was put into practice at Reistahl steel refining plant. This method utilizes a vacuum vessel hereinafter referred to as an RH furnace, which is characterized by having a suction tube and a discharge tube which are both attached to the bottom of RH furnace. In the degassing operation, the ladle in which the molten steel is charged is carried to a position immediately below the RH furnace. By introducing the inactive gas Argon into the suction tube, the molten steel is drawn up into the RH furnace through the suction tube and is degassed. The degassed molten steel then returns to the ladle through the discharge tube. The degassing operation is completed by repeating the above circuiting two or three times.

The repairing operations of the furnace lining of the above-mentioned DH durnace or RH furnace have been conventionally conducted manually and are subject to the following disadvantages:

(1) The operation has required several operators who are specialists respectively in the spraying operation, device manipulation, and the DH furnace manipulation.

(2) A blind spraying operation is conducted on the throat portion or the inner periphery of the suction tube since higher locations cannot be observed due to the possibility that refractory material or other high-temperature material such as remaining molten steel may fall onto the operator.

(3) The operation of connecting the spray nozzle, and the piping or hoses has required a great deal of time.

(4) The work must be conducted under an extremely hot furnace from which some adhering material may fall down, and therefore the operation involves very dangerous work.

Accordingly, it is an object of the present invention to overcome the aforementioned disadvantages by providing a method and an apparatus for automatically spraying refractory material onto a desired area such as the abraded or eroded portions of DH or RH furnaces.

It is another object of the present invention to provide a method and apparatus for automatically spraying refractory material onto a desired areas such as the abraded or eroded portions of DH or RH furnaces which are characterized by the use of a vertical spray pipe with a spray nozzle on the top thereof that is capable of being elevated and rotated on a transport car, whereby the spraying operation can be conducted with precision due to the mobility of the spray pipe.

It is still another object of the present invention to provide a method and apparatus for automatically spraying refractory material onto a desired area of DH or RH furnaces which is further characterized by having a cone-shaped recovery hopper around the spray pipe so that if extremely hot material such as any remaining molten metal or sprayed refractory material which cannot adhere to the inner surface of the furnace falls down, it will be collected in the hopper and will result in a highly safe and efficient spraying operation.

It might also be noted that the present invention may be used on other types of furnaces so long as the furnace can be repaired with a vertical spraying operation.

Other features which are considered characteristic of the invention are set forth in the appended claims.

Although the invention is illustrated and described in relationship to specific embodiments, it is nevertheless not intended to be limited to the details shown, since various modifications and structural changes may be made therein without departing from the spirit of the invention and within the scope and range of equivalents of the claims.

The construction and operation of the invention, however, together with additional objects and advantages thereof will be best understood from the following description of specific embodiments when read in connection with accompanying drawings.

SUMMARY OF THE INVENTION

A method for automatically repairing the lining of a furnace comprises the steps of providing a movable transport car on which a vertically disposed spray pipe is capable of being vertically displaced along its longitudinal axis and of being rotated about its longitudinal axis. The transport car is moved to a position underlying a furnace, and the spray pipe is elevated into the furnace to thereby dispose a spray nozzle on the end of the spray pipe within the furnace by remote control. The spray nozzle is directed to spray refractory material onto the abraded, eroded, and spalled areas of the refractory lining within the furnace.

Apparatus for automatically repairing the lining of a furnace comprises a movable car means, a vertically disposed spray means mounted on the car means and operable to spray a refractory material onto the lining of the furnace, elevating means on the car means for raising and lowering the spray means as the latter sprays the refractory material, and rotatable means on the car means for rotating the spray means as the latter sprays the refractory material with said car means mounted on a transport car, whereby the spray means is capable of automatically spraying refractory material onto the the various areas of the lining or the interior of the furnace.

BRIEF DESCRIPTION OF THE DRAWINGS

FIG. 10 is a partial elevational view showing the discharge chute and discharge passage of the apparatus.

FIG. 11 is a plan view of the discharge chute and discharge passage shown in FIG. 10.

DETAILED DESCRIPTION OF THE PREFERRED EMBODIMENTS

First Embodiment

Figure 1:
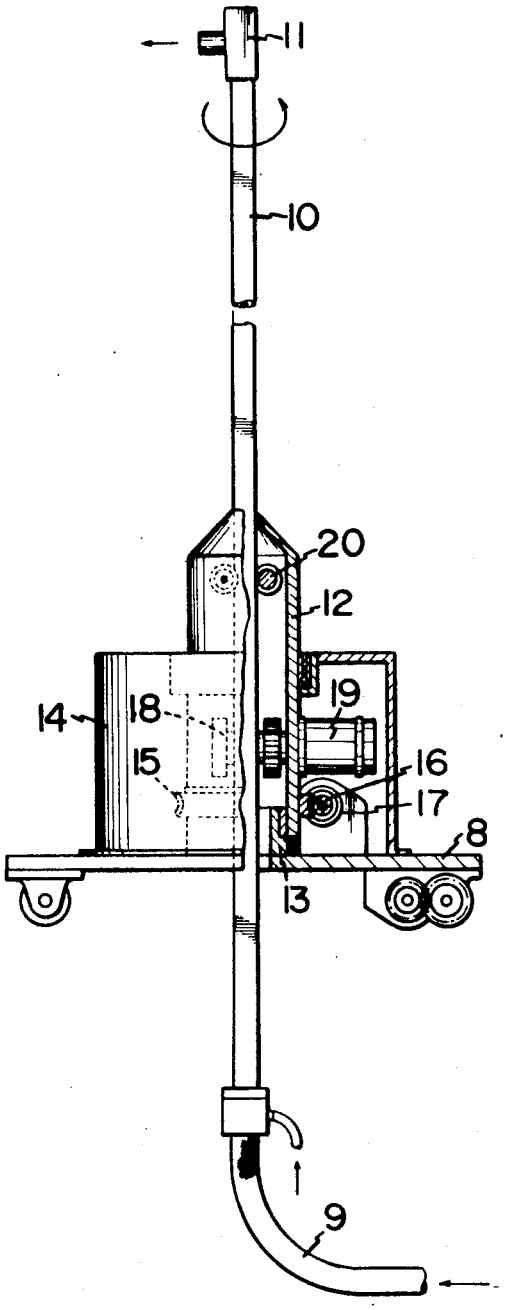
FIG. 1 is a front view, partly broken away and in section, of a spraying apparatus according to a first embodiment of the present invention.
Figure 2:
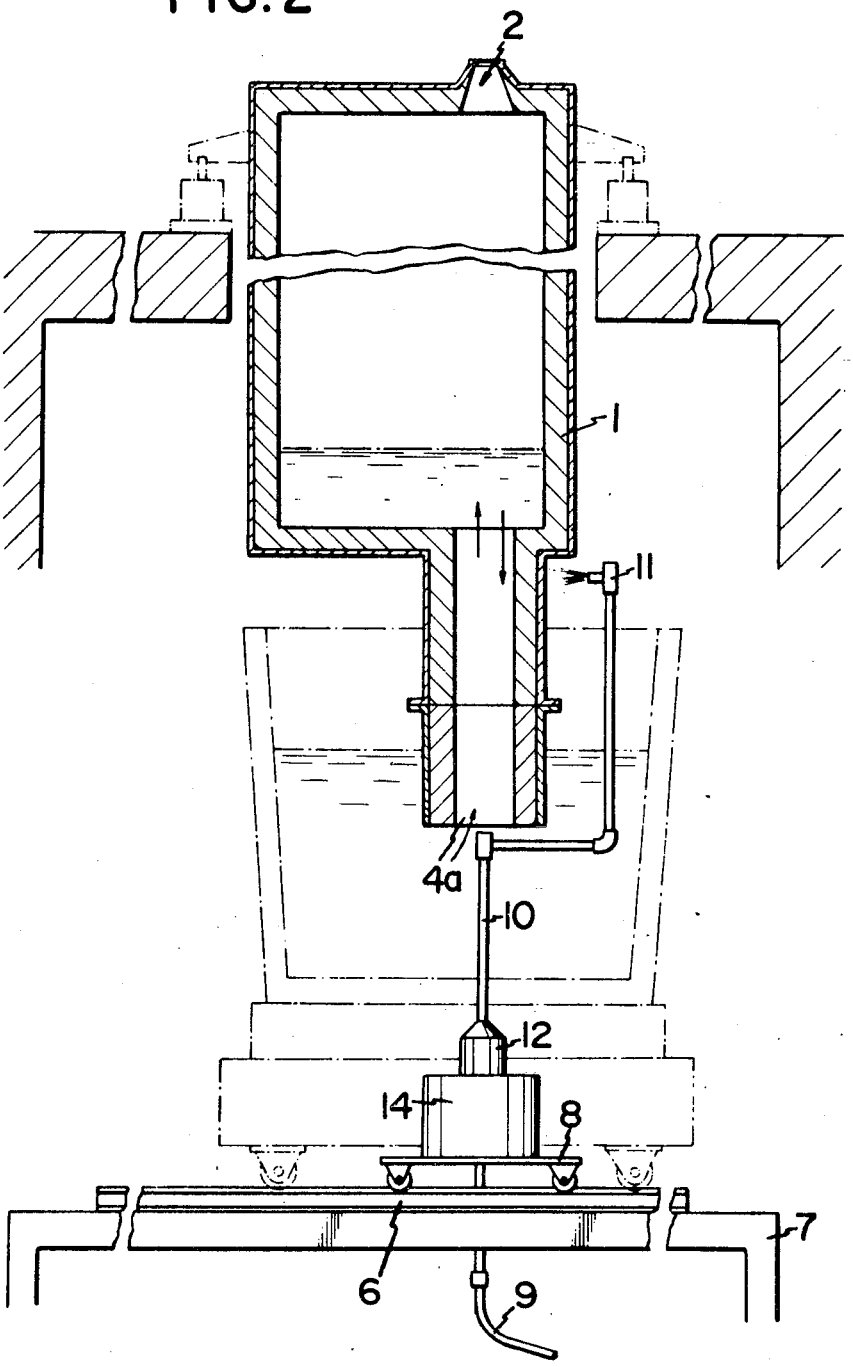
FIG. 2 is an elevational view, partly broken away and in section, of the spraying apparatus of FIG. 1 being used to repair a DH furnace.
Figure 3:
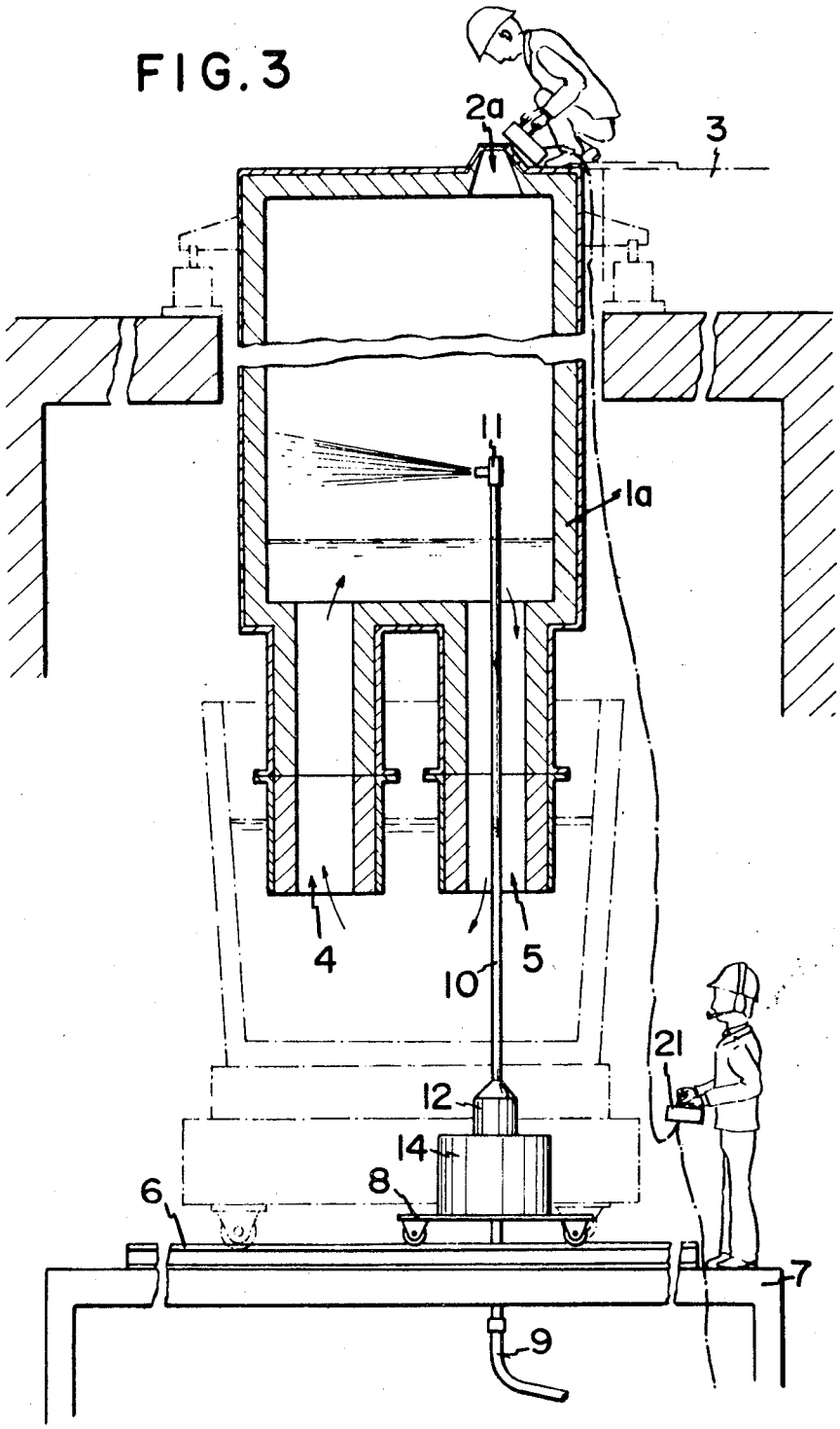
FIG. 3 is an elevational view, partly broken away and in section, of the spraying apparatus of FIG. 1 being used to repair an RH furnace.
Figure 4:
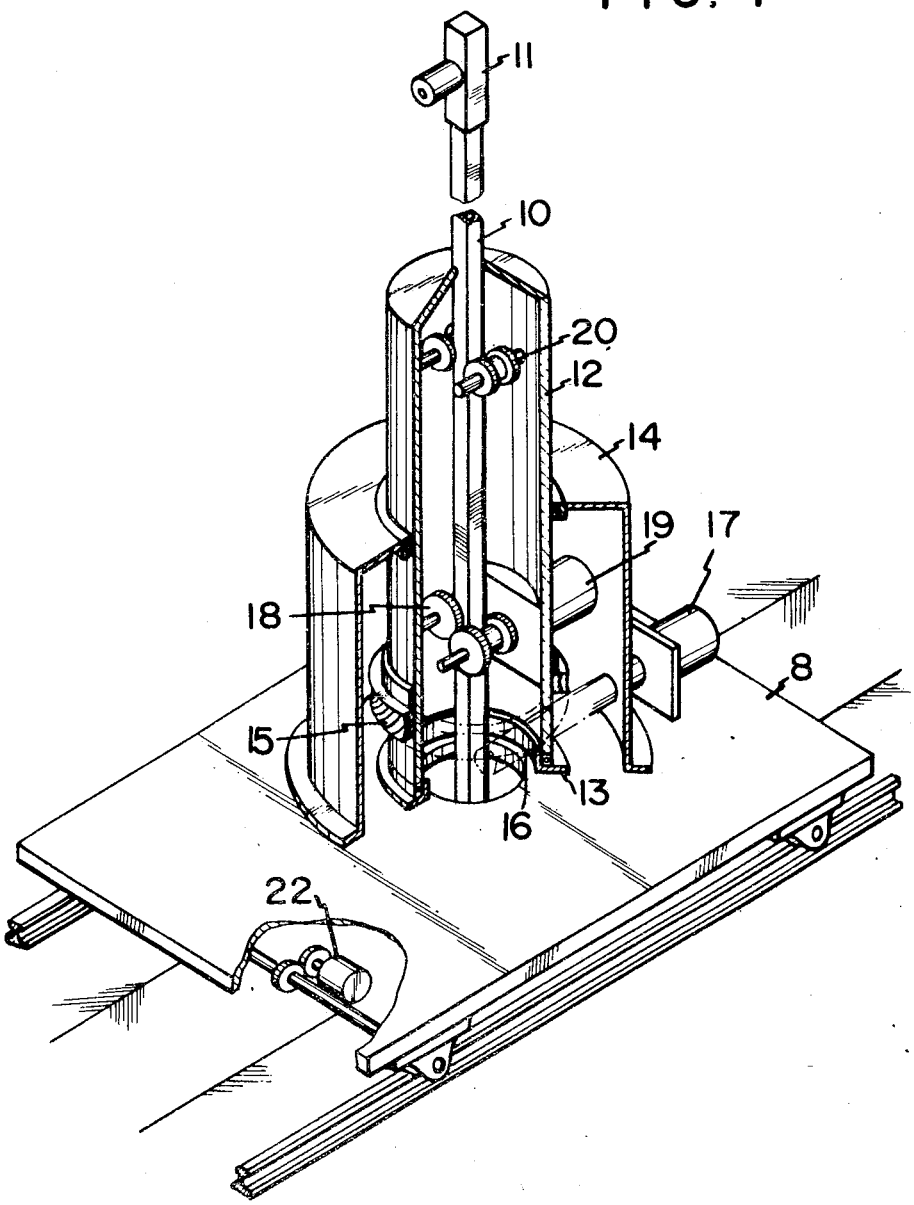
FIG. 4 is a perspective view, partly broken away and in section, showing the mechanism which causes the rotation and elevation of the spray pipe.
Figure 5:
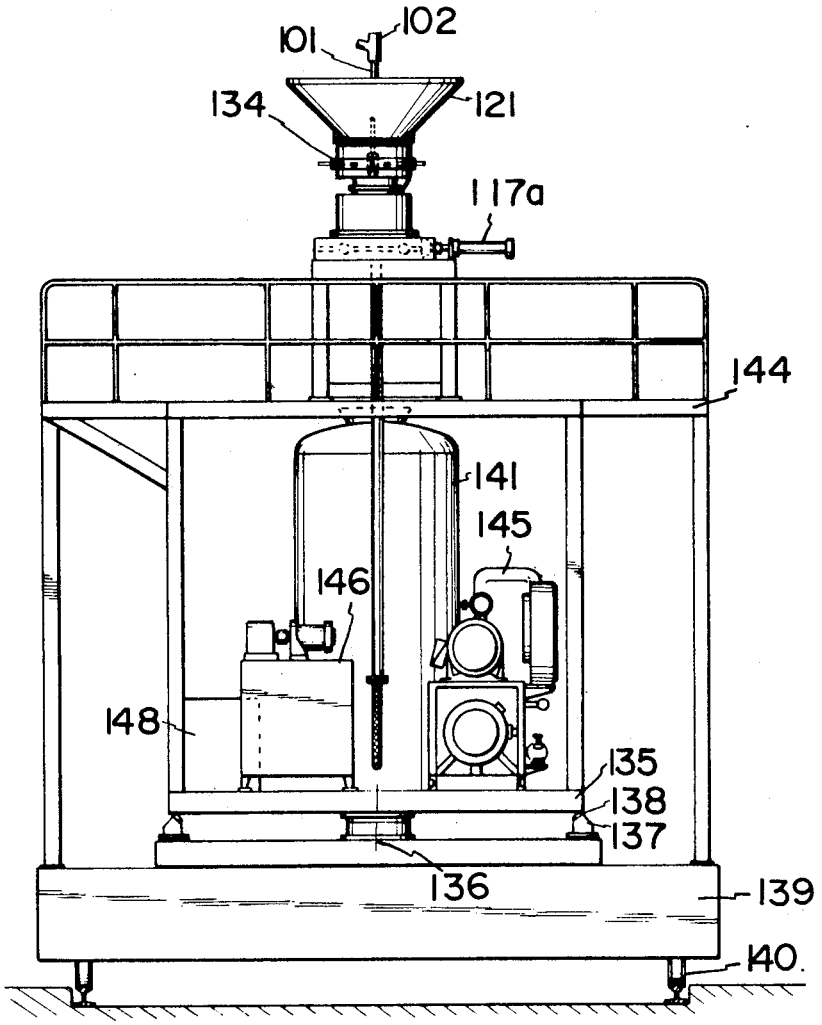
FIG. 5 is a front view of a spray apparatus according to a second embodiment of the present invention.

A typical structure of the apparatus of this invention is described with reference to the first embodiment shown in FIGS. 1 to 4.

Referring to FIGS. 1 to 4, numberal 1 (FIG. 2) indicates a DH furnace, numeral 1*a* (FIG. 3) indicates an RH furnace, numerals 2 and 2*a* indicate observation windows through which a viewer can observe the spraying operation within the furnace 1 and 1*a* and which is disposed on an upper working deck such as the working deck 3 over the furnace 1*a*. Numberals 4 and 5 in FIG. 3 respectively indicate a suction pipe and a discharge pipe of the furnace 1*a*. Numeral 4*a* in FIG. 2 indicates a suction pipe.

With respect to the apparatus which has been devised to enable the optimum degree of repair operations to the furnace, numberal 6 indicates rails laid on a lower working deck 7, numeral 8 indicates a transport car which is movable on the rails 6 and which carries the spraying device thereon, and numberal 9 indicates a hose for supplying refractory material in a wet slurry form through a spray pipe 10 to a spray nozzle 11 which is attached to the top of the spray pipe 10.

The mechanism for rotating the spray pipe 10 comprises an inner hollow cylindrical body 12 which permits elevation but which restricts rotation of the spray pipe 10 relative to the cylindrical body 12, a circular bearing means 13 mounted on the transport car 8 and which rotatably supports the inner cylindrical body 12, an outer cylindrical support frame 14 mounted on the car 8 and which also rotatably supports the inner cylindrical body 12, a worm gear 15 fixedly secured to the lower portion of the inner cylindrical body 12, and a worm gear 16 which is rotated by a power-operated motor 17 and which engages and drives the worm gear 15.

The mechanism to elevate the spray pipe 10 comprises elevating rollers 18 which contact and press against the spray pipe 10 from both sides, a power operated motor 19 mounted on the cylindrical body 12 and which effects rotation of the two rollers 18, and supporting rollers 20 mounted on the cylindrical body 12, which rotatably support the spray pipe 10.

Numberal 21 (FIG. 3) indicates a remote control means which is usually manipulated by an operator who stands on the lower working desk, and numeral 22 (FIG. 4) indicates a power operated means to move the transport car 8 along the rails 6.

Second Embodiment

With respect to the first embodiment described hereinbefore, when sprayed refractory material does not adhere to the inner surface of the furnace, it falls back alongside the spray pipe. In some cases molten metal at high temperature which usually adheres to the inner surface of the furnace may fall or splash down. Therefore, the operators of the apparatus and the operator who observes the spraying operation are exposed to dangerous working conditions so that sufficient observation of the abraded or eroded areas of the furnace cannot be conducted which results in an inefficient repair operation. In other cases, the operational site around the furnace becomes messy or dirty due to the fallen slag or other material from the furnace.

This embodiment provides an apparatus which is capable of spraying refractory material vertically and also safely and precisely, thereby overcoming the aforementioned disadvantages.

This invention relates to a method and apparatus for applying refractory material over the inner surface of a DH or RH type furnace which substantially comprises a transport car, a spray pipe that is perpendicularly disposed on the transport car having its distal end connected to a spray nozzle, a cone-shaped hopper with the wide open upper portion arranged to collect fallen material from the furnace, and a discharge chute which leads from the lower narrow portion of the cone-shaped hopper.

Apparatus of this second embodiment is described in great detail in conjunction with the accompanying FIG. 5 through FIG. 15.

In the drawings numerals 101 through 120 indicate mechanisms to cause vertical elevation and rotation of the spray pipe relative to the transport car. Thus numeral 101 indicates a spray pipe which supplies the refractory material in a wet slurry form to a spray nozzle 102 which is attached to the distal end of the spray pipe 101. Numeral 103 indicates a dual pipe means or dual pipe comprising two concentric pipes 103*a*, 103*b* which charge the powder-like refractory material and water separately therewithin, numeral 104 (FIGS. 6 and 12) indicates a pressure-transfer hose for the transfer of the refractory material, and numerals 105 and 105' indicate elevation rollers to raise and lower the dual pipe 103. Numeral 106 (FIG. 7) indicates a hydraulic-actuated motor to rotate elevation rollers 105 and 105' by way of gears 107 and 107', and numberals 108 and 108' (FIG. 8) indicate compression springs which biasingly urge rollers 105 and 105' respectively into contact with the dual pipe 103 so that they can prevent the dual pipe from falling by slipping.

Numerals 109 and 109' (FIG. 7) indicate guide rollers which are employed for supporting the dual pipe 103, numeral 110 (FIG. 7) indicates a worm gear to rotate the dual pipe 103, numeral 111 indicates a worm gear which is rotated by the actuation of a hydraulic-actuated motor 112, and numeral 113 (FIGS. 6 and 7) indicates a frame means or frame structure on which the previously described elevation rollers 105 and 105', the elevation guide rollers 109 and 109', and the worm gear 110 are supported. The frame structure 113 is rotatable with the dual pipe 103. Numeral 114 indicates a car means which provides for horizontal movement of the frame structure 113 and the dual pipe 103 mounted thereon. Numeral 115 (FIG. 7) indicates a bearing, for rotatably supporting the frame structure 113 on the car means 114 on rails 113*a*, numeral 116 indicates wheels which rotatably support the car means 114, numeral 117 indicates a connecting attachment which connects the car means 114 and a hydraulic-actuated device 117*a* for fine horizontal adjustment (FIG. 5), numeral 118 (FIG. 12) indicates a coupling means to connect the dual pipe 103 and the pressure-supply tube 104, numeral 119 indicates an introduction port for the cooling water which is used to cool the dual pipe 103 and is also mixed with refractory material, and numeral 120 indicates a supply passage for the spray water.

In the drawings numerals 121 through 127 indicate means relating to a cone-shaped recovery hopper for collecting the fallen refractory material. Thus, numeral 121 indicates a hopper body, numeral 122 (FIGS. 7, 9 and 13) indicates a support frame for supporting the hopper body 121, numeral 123 indicates a cylindrical body which is rotatably mounted on the previously described frame structure 113 and which carries the support frame 122 at the upper portion thereof, and numerals 124, 124', and 124'' (FIG. 9) are metal bearings which rotatably support and provide for the smooth rotation of the cylindrical body 123 rlative to the frame 113.

A bent bar indicated at 125 has its proximal end fixedly attached to the inclined side of the hopper 121, while 126 indicates a connecting lever which is pivotally attached to the distal end of the bent bar 125 for the purpose of releasably connecting the hopper body 121 and a plurality of teeth 127 which radially protrude from the outer periphery of the refractory material discharge chute as will be described in greater detail hereinafter.

Figure 13:
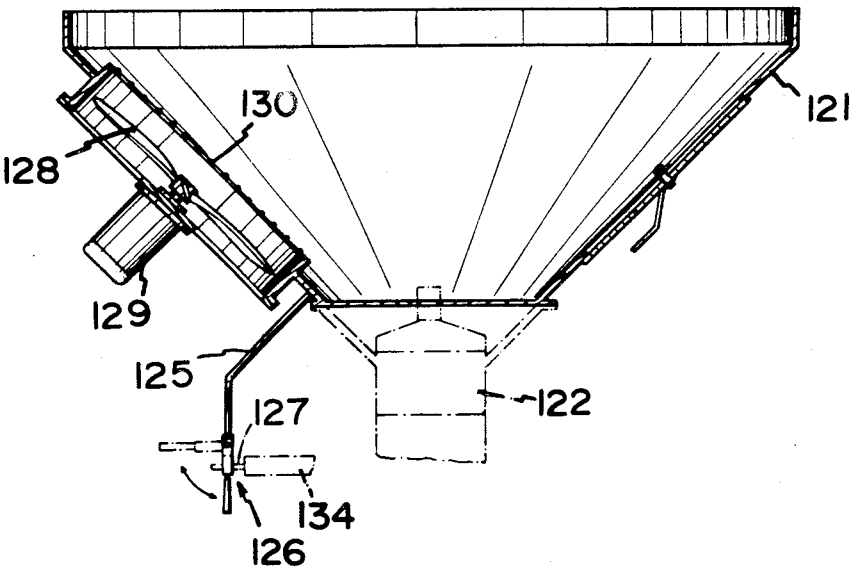
FIG. 13 is an enlarged cross-sectional view of the cone-shaped recovery hopper.
Figure 14:
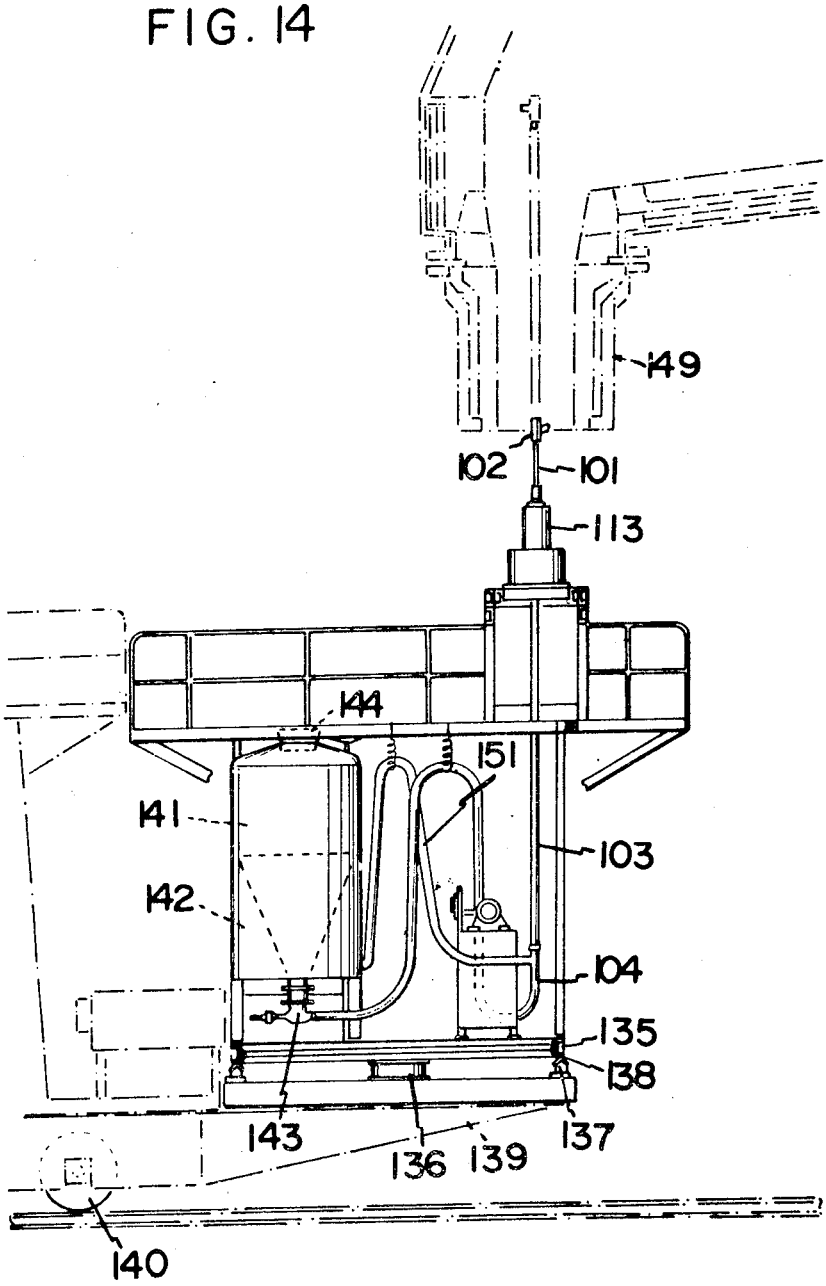
FIG. 14 is an elevational view of the apparatus of the second embodiment but without a recovery hopper.
Figure 15:
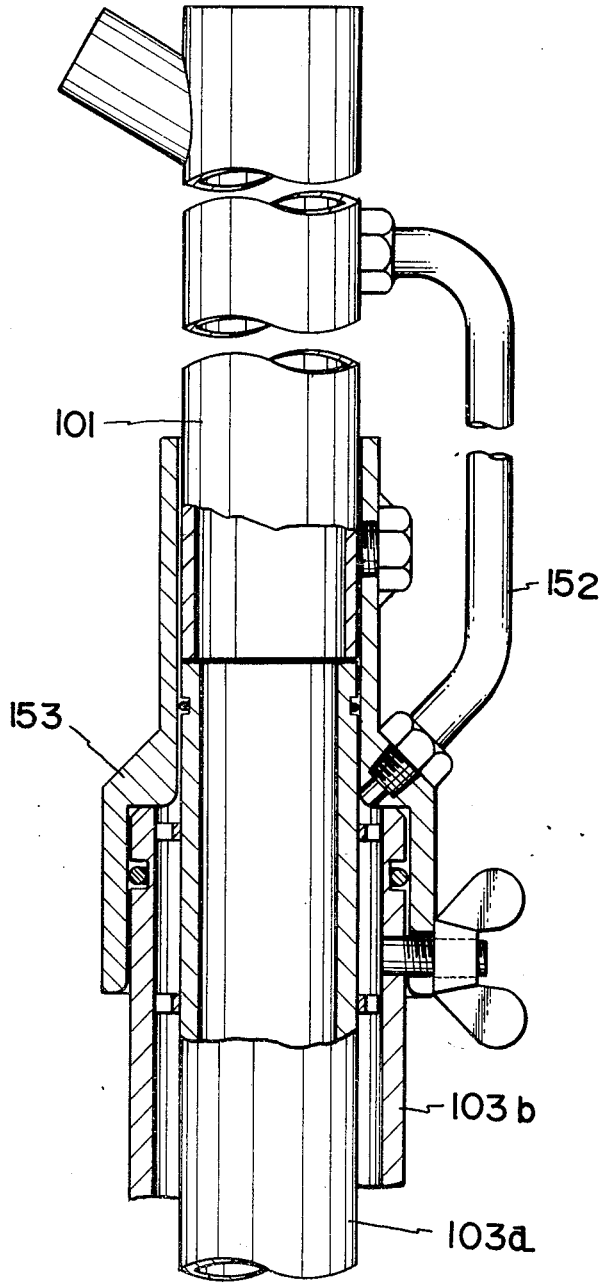
FIG. 15 is an enlarged longitudinal cross-sectional view showing the coupling portion of the spray nozzle.

In FIG. 13, numerals 128 through 130 indicate a fan device. Thus, 128 indicates rotary blades, numeral 129 indicates a power-operated motor for rotating the rotary blades 128, and numeral 130 indicates a net screen which is employed for safety purposes and observation purposes. The net screen 130 is employed for safety purposes while the fan, when driven, causes an air flow in a direction inwardly of the hopper so as to protect the operator viewing the interior of the furnace through the fan.

In the drawings, numerals 131 through 134 indicate means relating to the refractory material discharge chute wherein numeral 131 (FIGS. 10 and 11) indicates a discharge chute, numeral 132 indicates an opening formed in the inclined surface of the hopper body 121 and from which the fallen refractory material falls down into the chute 131, numeral 133 indicates a discharge passage, numeral 133*a* indicates a support for the chute 131, and numeral 134 indicates a ring means which is attached to the outer wall of the discharge chute 131 and has the plurality of teeth 127 (previously described) radially extending from the outer periphery thereof.

In the drawings, mumerals 135 through 149 indicate means and devices related with the turntable and other auxiliary devices wherein numeral 135 (FIGS. 5 and 6) indicates a turntable, numeral 136 indicates a rotating axis on which the turntable 135 is rotated, numeral 137 indicates a circular rail on which rollers 138 rotatably supporting the turntable 135 are mounted, numeral 139 indicates a transport car, and numeral 140 indicates wheels of the transport car 139.

Numeral 141 indicates a storage tank for refractory material, numeral 142 indicates a water storage tank, numeral 143 indicates a known refractory-material charging device which makes use of air pressure, for carrying the refractory material through pipe 104, and numeral 144 indicates a working deck. Numeral 145 (FIG. 5) indicates a compressor for supplying the compressed air for carrying the refractory material in pipe 104, numeral 146 indicates a hydraulic unit which supplies required amount of oil to the hydraulic-actuated devices used in the apparatus, numeral 148 indicates a reservoir for the fallen refractory material, numeral 151 indicates a water-introduction hose for carrying water from the water tank 142 to the coupling 118, and numeral 149 indicates a reactor furnace.

Figure 6:
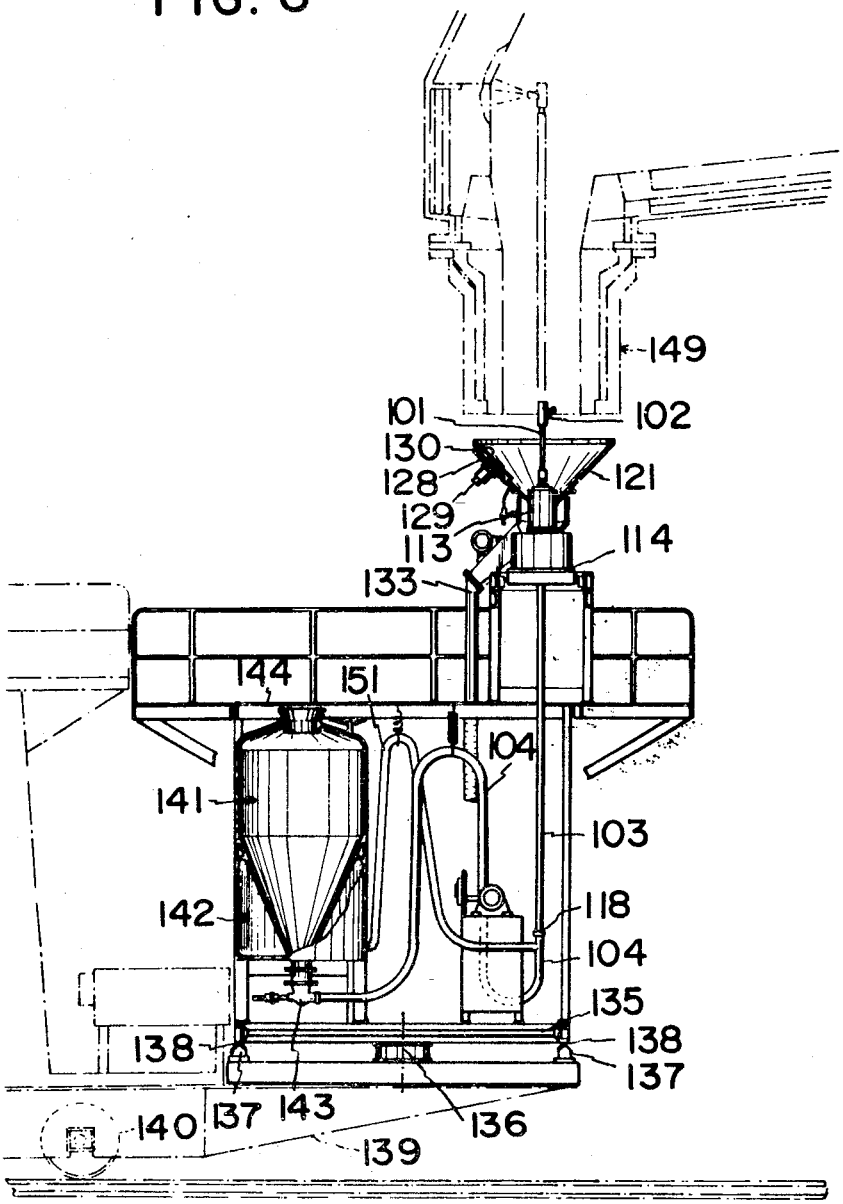
FIG. 6 is a side view of the apparatus shown in FIG. 5.
Figure 7:
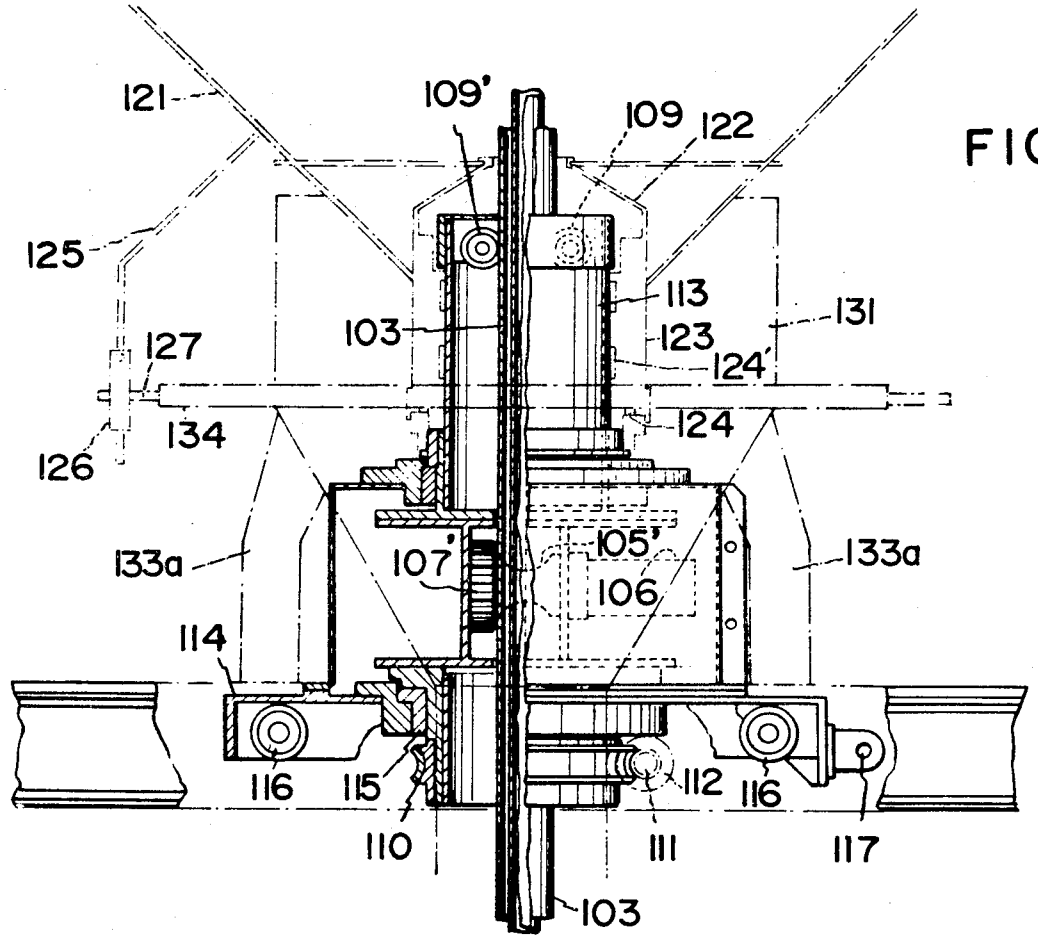
FIG. 7 is a partially broken away and enlarged side view showing the mechanisms which elevate and rotate the spray pipe.
Figure 8:
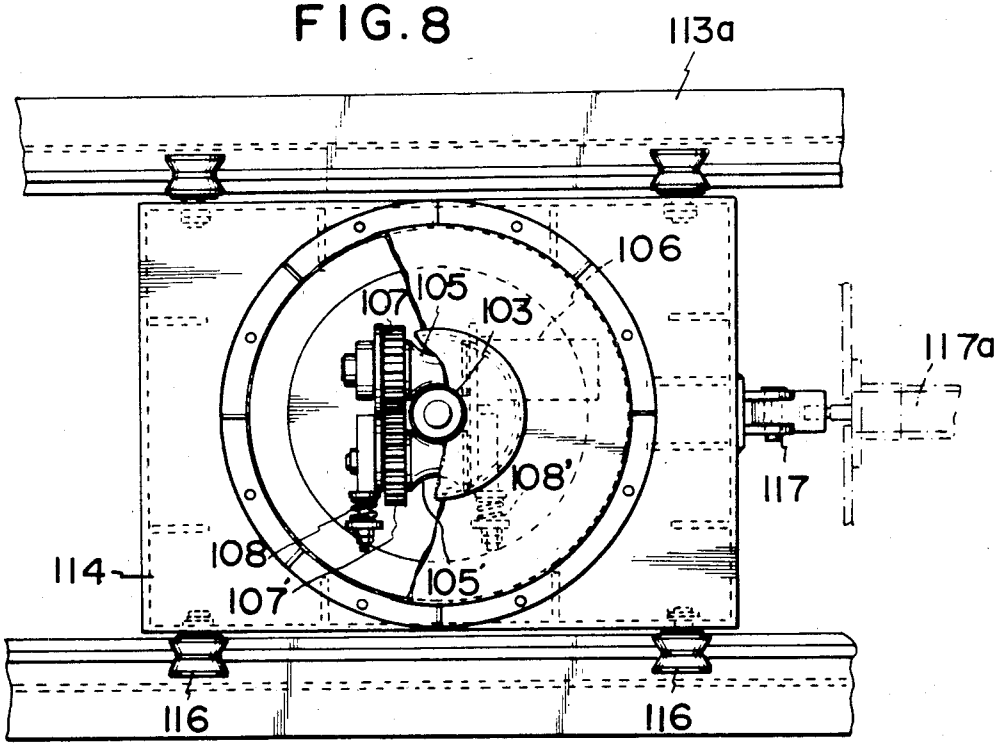
FIG. 8 is a partially broken away enlarged plan view showing particularly the mechanism which elevates the spray pipe.
Figure 9:
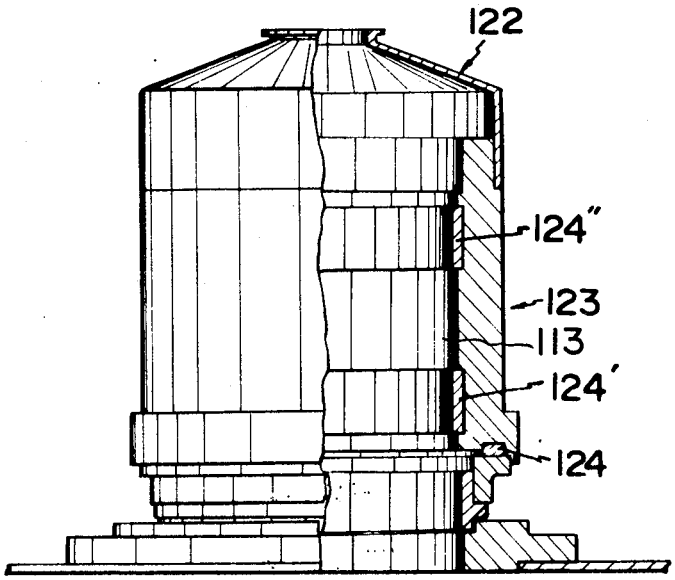
FIG. 9 is a partially broken away and enlarged view showing the combination of the support frame, the cylindrical structure, and the bearings for rotatably supporting the hopper.
Figure 12:
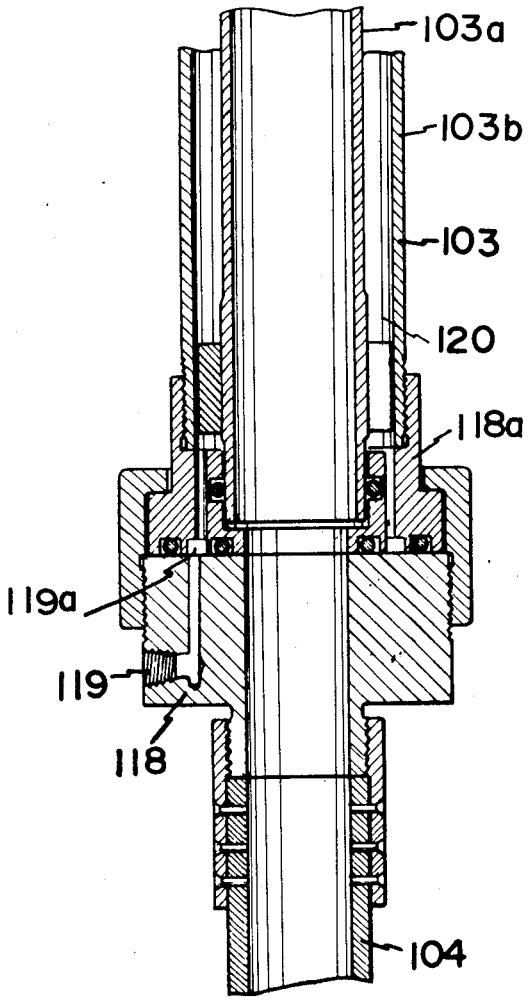
FIG. 12 is an enlarged longitudinal cross-sectional view showing the coupling portion of the spray pipe.

It will be seen that the car means 114 is movably mounted on the upper portion of the turntable by the rollers 116 (FIGS. 7 and 8). Also as best shown in FIG. 6, the longitudinal axis of the dual pipe 103 is offset relative to the rotational axis 136 of the turntable 135.

Numeral 152 (FIG. 15) indicates a flexible heat-resisting hose which conveys the water from the dual pipe 103 to the spray nozzle 102 within which the mixing of the refractory material and water takes place.

Numeral 153 indicates a coupling means which connects the spray nozzle 101 and the dual pipe 103.

The manner in which the apparatus of the present invention is operated is described hereinafter in conjunction with the attached drawings.

The refractory material in the storage tank 141 and the water in the water storage tank 142 are charged into the dual pipe 103 by way of the refractory supply pipe 104 and the water introduction hose 151, and then they are mixed together at a position where the spray pipe 101 and the dual pipe 103 are integrally connected. The mixed material (the refractory material in a wet slurry form) then passes through the spray pipe 101 until it reaches the spray nozzle 102 from which it is sprayed onto the desired surface of the furnace.

When elevation of the spray pipe 101 is desired, the dual pipe 103 is raised or lowered by means of the power driven elevation rollers 105 and 105'. The spray pipe 101, the dual pipe 103, the elevation rollers 105, 105' and the guide rollers 109 and 109', which are all supported on the frame structure 113, are rotated when the frame structure 113 is rotated by means of the mechanism which comprises the worm gear 110 and the worm gear 111. It will be noted that the worm gear 111 is rotatably mounted on the car means 114. Thus the spray pipe 101 is capable of both elevation and rotation.

Although it is an ideal of the spraying operation that the refractory material sprayed onto the outer or inner surface of the furnace all adhere to the above surfaces, practically speaking there are some portions of the sprayed refractory material which do not adhere to the furnace surfaces and fall or splash down. The fallen refractory material and the molten metal pieces are all received within the hopper body 121 and then fall into the discharge chute 131 through the opening 132 and are discharged through the discharge passage 133 to the reservoir 148.

Accordingly, the operator can safely conduct the spraying operation without worrying about the possible fallen materials since the operation site where he stands is entirely covered or protected by the cone-shaped hopper body 121. Furthermore, since the hopper body 121 has the opening onto which a power operated fan with the rotary blades 128 is mounted, the operator who stands on the working deck 144 can see the inside of the furnace 149 while the fan is actuated so that prompt discovery of the abraded areas, observation of the spraying operation or the degree of fracture of the furnace lining can be achieved resulting in the correct spraying operation.

Furthermore, the hopper body 121 is supported by the support frame 122 and the support frame 122 is rotatably supported by the frame structure 113 by means of metal bearings 124, 124' and 124'' which are disposed between the frame structure 113 and the cylindrical body 123, and therefore when the connecting lever 126 of the bent bar 125 which has its proximal end attached to the hopper body 121 is engaged with the teeth 127 which are fixedly secured to the discharge chute 131 by way of the ring 134, the hopper body 121 is stationarily disposed while when the connecting lever 126 is disconnected from the above engagement with the teeth 127, the hopper body 121 is rotated by the rotation of the frame structure 113 due to the friction between the metal bearing 124 and the frame structure 113 so that the relative relationship of the position between the spray nozzle 102 and the fan means (the rotary blades 128) from which the sprayed portion can be observed is maintained thus enabling the operator to observe any spraying operation.

In this case, the operator or the viewer must move around the stand always below the fan means following the rotation of the hopper body 121 and the spray nozzle 102.

The relative relationship of the position between the spray nozzle 102 and the rotary blades 128 can be adjusted by the selection of a protruding tooth 127 which is engaged by the lever 126.

Furthermore, since these devices are mounted on the turntable 135 the spray nozzle 102 is rotatable about an axis offset from the axis of rotation 136 of the turntable whereby the rotation and displacement within the furnace can be achieved.

Still furthermore, when the turntable 135 is moved such that the axis of rotating shaft 136 is in alignment with the axis of the suction tube of the reactor furnace 149, the movement of the spray nozzle 102 around the suction tube is facilitated so that the outer periphery of the suction pipe can be easily and correctly repaired.

According to this invention, the spraying apparatus includes a cone-shaped hopper for collecting the fallen refractory material and has the following advantages:

(1) the spraying operation can be conducted with great safety and without making the operation site dirty and messy, (2) since the fan means is attached to the inclined surface of the cone-shaped recovery hopper, the fracture or abraded condition of the furnace can be observed, and the spraying operation within the furnace can be observed so that the spraying operation can be conducted correctly and in a short time, and (3) since the device is mounted on the turntable, the mobility of the spray nozzle is highly improved.

It is thought that the invention and many of its attendant advantages will be understood from the foregoing description and that it will be apparent that various changes may be made in the form, construction, and arrangements of the parts without departing from the spirit and scope of the invention or sacrificing all of its material advantages. The form heretofore described being merely a preferred embodiment thereof.

What is claimed is:

1. In a method for automatically repairing the lining of a furnace comprising the steps of providing a movable transport car on which a vertically disposed spray pipe is capable of being vertically displaced along its longitudinal axis and of being rotated about its longitudinal axis, moving said transport car to a position underlying a furnace, elevating said spray pipe through an opening in the furnace into said furnace to thereby dispose a spray nozzle on the end of said spray pipe within said furnace by remote control, directing said spray nozzle to spray refractory material onto the abraded, eroded and spalled areas of the refractory lining within said furnace, and automatically directing unadhered falling and other refractory material falling from said furnace opening directly into a recovery hopper underlying the furnace opening.

2. A method according to claim 1 further comprising utilizing said recovery hopper to provide for observation of the interior of said furnace during spraying of said refractory material.

3. A method according to claim 1 further comprising the step of directing an air flow inwardly of said hopper by use of a fan to protect an operator viewing the interior of said furnace through said fan.

4. A method according to claim 3 further comprising the steps of screening off said fan while the operator can safely view the interior of the furnace through said screen, said screening off being effected by a screen.

5. A method according to claim 3 further comprising rotating said hopper and thereby enabling an operator to observe the spraying operation through said fan during such rotation of said hopper.

6. A method according to claim 3 further comprising rotating said hopper about a vertical rotary axis and displacing said fan about the rotary axis of the hopper and thereby enabling an operator to observe the spraying operation through said fan during such rotation of said hopper.

7. A method according to claim 3 further comprising disposing the rotational axis of said fan at an acute angle relative to vertical, rotating said hopper about a vertical axis, and locating said fan at a position displaced from the rotational axis of said hopper such that rotation of said hopper displaces said fan about said hopper rotating axis and an operator is able to observe the spraying operation through the fan during rotation of said hopper.

8. A method according to claim 2 wherein said collecting of said unadhered and other refractory material comprises directing said material in a direction inclinded to vertical by utilizing a cone-shaped hopper.

* * * * *